United States Patent [19]

Braun

[11] Patent Number: 4,867,084

[45] Date of Patent: Sep. 19, 1989

[54] SEWING MACHINE WITH A PRESSER FOOT DRIVABLE IN TRANSVERSE DIRECTION BY THE NEEDLE BAR

[75] Inventor: Oskar Braun, Hochspeyer, Fed. Rep. of Germany

[73] Assignee: G. M. Pfaff Aktiengesellschaft, Fed. Rep. of Germany

[21] Appl. No.: 210,631

[22] Filed: Jun. 23, 1988

[30] Foreign Application Priority Data

Jun. 27, 1987 [DE] Fed. Rep. of Germany ..... 3721331

[51] Int. Cl.[4] ..... D05B 3/02; D05B 55/14

[52] U.S. Cl. ..... 112/221; 112/310; 112/443

[58] Field of Search ..... 112/443, 221, 310

[56] References Cited

U.S. PATENT DOCUMENTS

| | | | |
|---|---|---|---|
| 3,799,090 | 3/1974 | Sheroff | 112/221 |
| 4,129,084 | 12/1978 | Kihara | 112/221 |
| 4,303,028 | 12/1981 | Takenoya et al. | 112/443 |
| 4,323,020 | 4/1982 | Thompson | 112/310 X |

FOREIGN PATENT DOCUMENTS 49-9491 6/1974 Japan .

*Primary Examiner*—Andrew M. Falik
*Attorney, Agent, or Firm*—McGlew & Tuttle

[57] ABSTRACT

In a sewing machine with a needle bar executing transverse motions and with a pressing arrangement whose foot can be lowered onto the work piece laterally with regard to its central position when the needle bar executes lateral movements, the presser arrangement and its drive connection to the needle bar is executed so that a minimal moment of inertia is exerted on the needle bar when driving the pressure arrangement and so that the pressure foot always generates a load evenly spread over the pressed surface, independent of the width of its lateral movements. For this purpose the presser foot is movable in transverse direction relative to the other parts of the pressing arrangement and it is guided parallel to the work piece surface by a guiding arrangement. The transverse movement of the presser arrangement is taken from the transverse movement of the needle bar by a driving connection. The driving connection is formed by a driving linkage connected to the needle bar and by a catch connected to the presser foot.

14 Claims, 4 Drawing Sheets

SEWING MACHINE WITH A PRESSER FOOT DRIVABLE IN TRANSVERSE DIRECTION BY THE NEEDLE BAR

BACKGROUND OF THE INVENTION

Field Of The Invention

This invention relates in general to a sewing machine, and in particular to a new and useful machine having a drive for a presser.

In zig zag sewing machines, both the press foot and the needle plate are usually provided with a slotlike sewing hole, the dimensions of which, transverse to the direction of feed of the sewing material are determined by the maximum cross stitch width. Such large sewing holes are a disadvantage, since the sewing material can only inadequately be supported against the forces exerted by the needle at the site of formation of the stitch.

It is common in such sewing machines to adapt the size of the sewing hole to the type of stitch being executed. The needle plate of the familiar sewing machine from U.S. Pat. No. 4,303,028 has a slotlike sewing hole, the dimensions of which transverse to the direction of feed, of the sewing material, can be reduced by a relatively cumbersome controlling unit after adjusting the machine to a straight stitch. In this case, no individual adaptation of the size of the sewing hole to rather small cross stitch widths is provided, nor even possible.

Since the sewing hole of the particular press foot which is installed cannot be altered by the aforesaid controlling unit, either the press foot provided for zig zag stitches must be used to produce straight stitches, or the press feet must be changed with the type of stitch. This gives rise to the danger that, by mistaken handling of the zig zag mechanism, the stitch forming unit and the sewing hole of the needle plate will be converted to a zig zag stitch, but it will be forgotten to change the press foot provided for straight stitch. This might cause damage to the press foot, as well as to parts of the stitch forming unit.

U.S. Pat. No. 4,303,082 describes a further modification of such arrangement, whereby the press foot corresponding to the type of stitch used on each occasion correspondingly activates both the zig zag mechanism and the controlling unit for the needle plate. This modification, as well, requires a time consuming changing of the press foot to change the type of stitch.

From Japanese declaration No. 49-9491, a holder used to carry a press foot is fastened to the needle bar. The press foot is carried in a bearing block, likewise fastened to the needle bar, whereby this simultaneously acts as an abutment for the pressing spring. By this arrangement, the entire pressing mechanism takes part in the transverse movements of the needle bar, so that the moment of inertia of the latter is significantly increased.

Since the press bar in this arrangement is always raised along with the needle bar, and the needle bar moves backward against the force of the pressing spring, a relatively large force is needed to actuate the needle bar. Furthermore, the supporting of the sewing material by the press foot when the needle emerges is not optimal, since the pressing spring is at least partly relieved of tension by the raising of the needle bar.

SUMMARY OF THE INVENTION

The invention provides a pressing mechanism with a press bar and a press foot, of which the moment of inertia is minimal. It is possible to dispense with the changing of the press foot when the type of stitch is changed, while the sewing hole can be optimally adapted to the particular cross stitch width, in order to support the sewing material sufficiently well against the action of the emerging needle.

In accordance with the invention a driver produces a driving linkage which can be used to transfer the transverse motions of a needle bar carrier to the press bar. The press foot in this process is always moved far enough so that the needle for each adjusted cross stitch width is always inserted at nearly the same position of the sewing hole formed in the press foot. Thus, even for the largest cross stitch width, only a single sewing hole is needed, corresponding to the size of the sewing hole for the straight stitch. Because of the small size of sewing hole required, the sewing material is well supported by the press foot even when producing a zig zag seam, substantially lessening the tension at the site of formation of the stitch.

According to the invention a geared linkage between the needle bar carrier and the press bar is provided which dispenses with the otherwise necessary drive unit for the press bar, which would have to be actuated in synchronization with the drive of the needle bar carrier. Since the press bar is directly actuated by the needle bar carrier, this element is moved relative to the sewing material only when the needle is located above the sewing material, since the needle bar carrier executes no transverse motions when the needle is inserted in the sewing material. Hence, the sewing material is given optimal support by the press foot during the overall phase of formation of a stitch.

According to the invention, the press bar is swivel mounted. The press bar thereby presents an especially small moment of inertia to the driving needle bar carrier, as the heavier elements of the press bar, such as the press foot, are situated at relatively short distance from its lengthwise axis of the needle bar.

The pressing mechanism includes a sleeve having a bearing for the press bar making it is possible to mount the press bar at minimal technical expense in such a way that it can be moved in the requisite manner.

The invention provides balls which are arranged between a spring and the press bar, as a result the frictional resistance between the pressing spring and the press bar can be reduced to a minimum, as the balls roll against each other during the vertical and horizontal motions of the press bar.

Advantageously, structurally very simple and lightweight configurations of the driving means and the driver are possible. Having a guide machined in a plate in the form of a slot or groove makes it possible to move the driver and, consequently, also the press bar in the direction of extension of the guide, relative to the needle bar carrier. The direction of extension is, thus, preferably vertical, in order to allow lowering the press foot onto the sewing material or lifting it therefrom, without this lifting motion being transmitted to the needle bar carrier.

The driver is advantageously peg-shaped driver and has a free end with a spherical shape, so that the peg can swivel about its free end with the least possible friction in vertical and horizontal direction in the guide groove of the driving means.

Accordingly, it is an object of the invention to provide a sewing machine which includes a hollow needle bar carrier which is supported for pivotal movement about a substantially horizontal axis to permit transfer swinging movement of the carrier including a needle bar which is in the carrier and reciprocates upwardly and downwardly therein, and is adapted to carry a sewing needle at its lower end which engages the material to be sewn and which further includes a press foot which is connected for movement with the area to permit transfer swinging thereof which has a press foot at its lower end with an opening through which the needle is reciprocated.

A further object of the invention is to provide a needle bar and press foot assembly constructed to cooperate together to permit reciprocation of the needle carried by a needle bar and swinging movement of the presser bar which has a foot which engages the material and has an opening through which the needle passes.

A further object of the invention is provide a sewing machine having a presser foot which is movable with a sewing needle for both straight and zig zag stitching and which is simple in design, rugged in construction, and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS

In the drawings:

FIG. 4 is an elevational view of a needle bar carrier mounted in the head;

FIG. 5 is a section through the needle bar carrier along line V—V of FIG. 4;

GENERAL DESCRIPTION OF THE PREFERRED EMBODIMENTS

Figure 9:
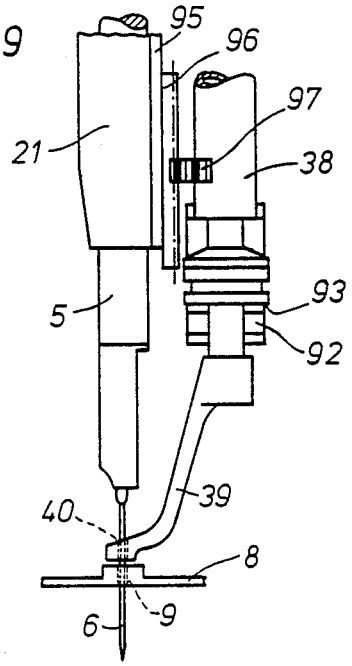
FIG. 9 is a side elevational view of a needle bar carrier, needle bar, and pressing mechanism of a different embodiment of the invention.
Figure 2:
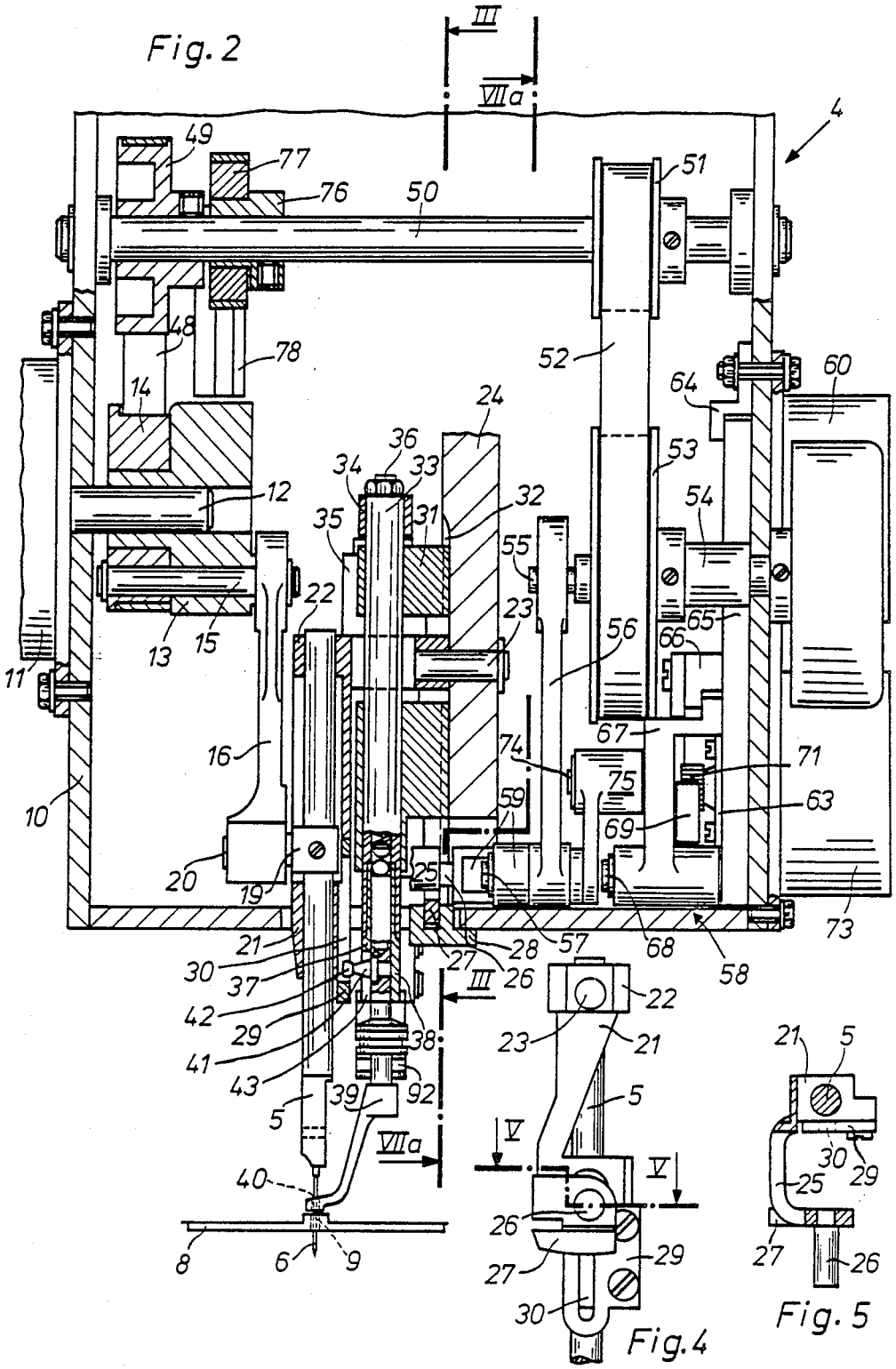
FIG. 2 is a section taken along the line II—II of FIG. 3 through a head of a sewing machine of FIG. 1.

Referring to the drawings in particular, the invention embodied therein comprises a sewing machine which includes a hollow needle bar carrier 21 shown both in FIG. 2 and 9 which is supported in a sewing machine head 4, for pivotal movement about a substantially horizontal axis which is intermediate in its height to permit transfer swinging movement thereof such as for zig zag stitching. A needle bar 5 is adapted to carry a sewing needle 6 at its lower end, and is reciprocatable in the carrier 21. In accordance with the invention, a press foot bar 38 is associated with the needle bar carrier 21 and it carries a press foot 39 with an opening 40 for the sewing needle to pass through. The press foot 39 is adapted to overly the material being sewn and the needle 6 reciprocates through the opening 40 of the press foot during operation. A feature of the invention is that the press foot bar is mounted alongside the needle carrier 21 and it is also driven so that the needle bar 539 is movable in a transfer swinging movement along with the needle bar carrier 21. In both the embodiment of the invention indicated in FIG. 2, and the embodiments shown in FIG. 9 and 10, there is a connection between the press foot bar 38 and the needle bar carrier 21, so that the press foot 39 moves through a transfer swinging movement in timed relationship to the swinging movement of the needle bar 5.

Figure 1:
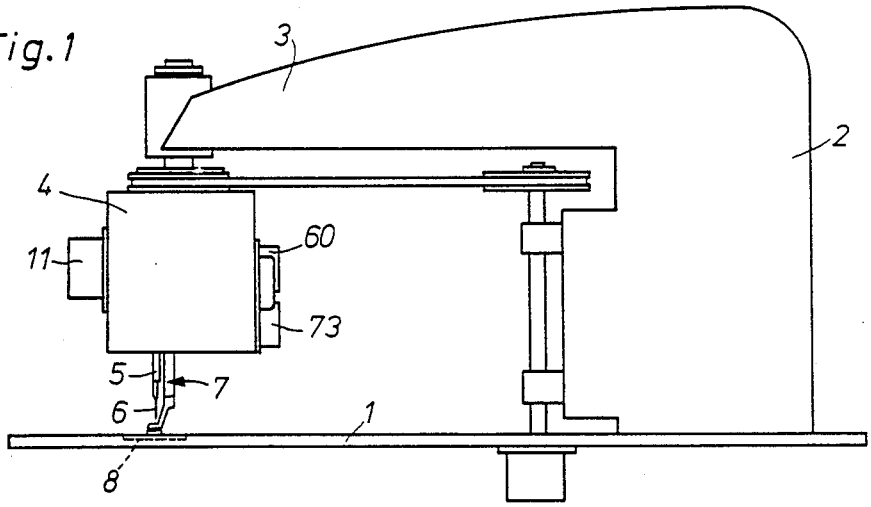
FIG. 1 is a side elevational view of a sewing machine constructed in accordance with the invention.

FIG. 1 shows a sewing machine whose housing comprises a base plate 1, a stand 2, an arm 3, and a head 4 that is swivel-mounted on the arm 3. In the head 4 is mounted a needle bar 5 with a needle 6 and a pressing mechanism arrangement or press foot assembly 7. In the base plate 1, a needle plate 8 is accommodated, which has a sewing hole 9, FIG. 2.

The head 4 is shown magnified in FIG. 2. A motor 11 is flanged to the housing 10 of the head 4, the motor shaft 12 being led in through the housing 10. On the motor shaft 12 is fastened a crank 13, which carries a toothed belt gear 14 and is firmly joined to the latter by means of a journal 15. The end of the journal 15, projecting beyond the crank 13 is grasped by an eccentric rod 16. Secured to the needle bar 5 is a clamp 19, formed as a single piece with a journal 20, which is grasped by the other end of the eccentric rod 16.

The needle bar 5 can move up and down in the direction of its lengthwise axis in a needle bar carrier 21, swivel-mounted in the housing 10. For the swivel mounting, the needle bar carrier 21 has a shackle 22, on which a bearing journal 23 is fastened. The bearing journal 23 is swivel-mounted in a bearing rib 24 of the housing 10.

At the lower end of the needle bar carrier 21 is formed another shackle 25 FIG. 5, provided with a journal 26. The shackle 25 is joined to a guide rocker 27, which is moved in a groove of a guide plate 28, arranged on the housing 10.

At the lower end of the needle bar carrier 21, at the side facing the pressing arrangement 7, there is secured a plate 29, provided with a slot 30.

Figure 3:
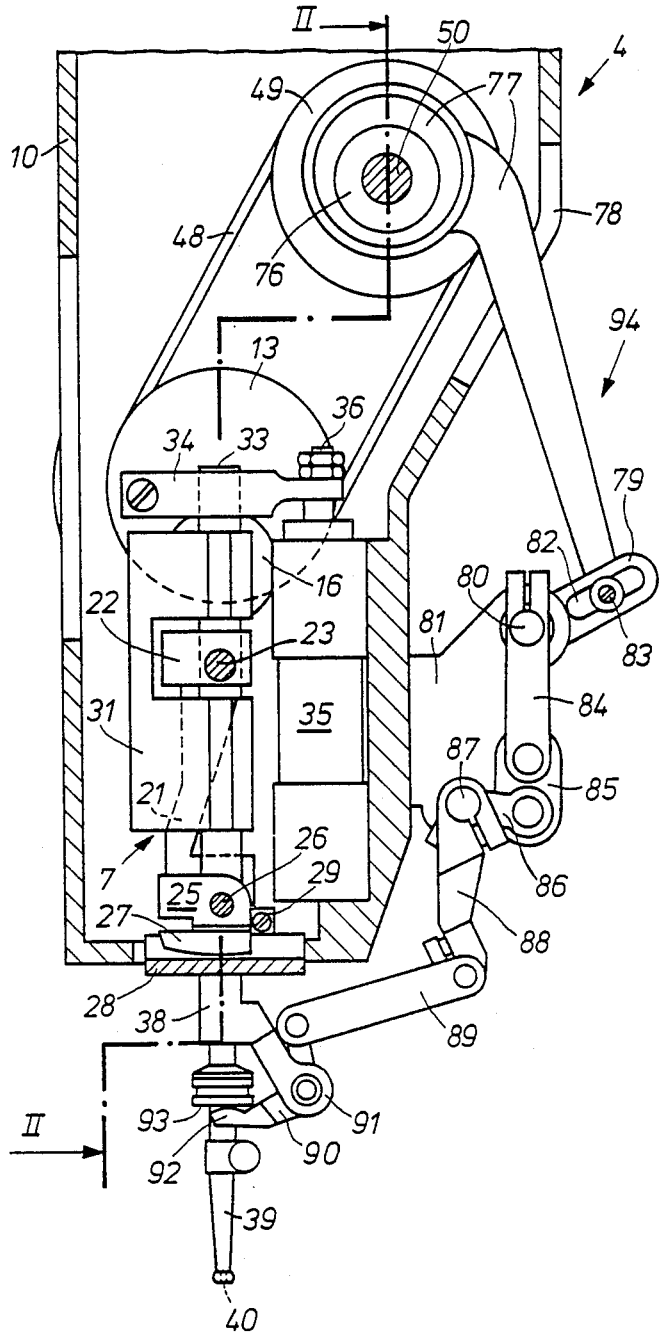
FIG. 3 is a section through the head along line III—III of FIG. 2.

In the housing 10, a carrier 31 for the pressing arrangement 7 is accommodated, able to move in the vertical direction. The carrier 31 protrudes into a groove 32 of the bearing rib 24 for guidance in the vertical direction. The carrier 31 accommodates a sleeve 33, extending in the vertical direction, the upper end of which is grasped by a clamp 34. Arranged on one of the inner walls of the housing 10 is a fluid-activated cylinder 35 FIG. 3, to attached the piston rod 36 to which the clamp 34 is secured.

Figure 6:
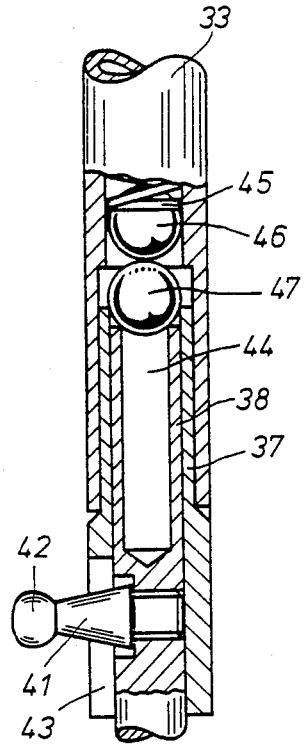
FIG. 6 is a magnified segment of a press foot mounted in the head, in partial cutaway view.

The lower end of the sleeve 33 accommodates a bushing 37 FIG. 6. In the bushing 37, the press bar 38 is accommodated, able to slide in the direction of its lengthwise axis and to pivot about this axis. The press bar 38 carries a press foot 39 FIG. 2 with a sewing hole 40. The pressing arrangement 7 is composed of parts 31 and 33 through 39.

On the press bar 38, at the side facing the needle bar carrier 21, is secured a peg 41, the free end 42 of which is shaped as a ball. The bushing 37 is provided with a slot 43 for the passage of the peg 41. The spherical end 42 protruding through the slot 43 engages in the slot 30 of the plate 29, serving as a guide.

The press bar 38 is provided with a bore 44 FIG. 6, exiting at the upper end. This end of the press bar 38 is loaded by a pressing spring 45, accommodated in the sleeve 33, which transmits its force across adjoining balls 46 and 47 to the press bar 38. The ball 46 is moved by the adjoining turn of the pressing spring 45, while the ball 47 is partly admitted into the bore of the press bar 38.

The motion derived from the toothed belt gear 14 FIG. 2 is conveyed via a toothed belt 48 to a toothed belt gear 49, which if firmly secured on a shaft 50, rotatable in the housing 10. The rotational motion of the shaft 50 is transmitted by a toothed belt gear 51, seated on the shaft, across the toothed belt 52 to a toothed belt gear 53, which is fastened on a driven shaft 54, rotatable in the housing 10.

One end of the driven shaft 54 has a journal 55 formed eccentric to the axis of the shaft. The journal 55 is grasped by an eccentric rod 56, which is also connected to a journal 57 of a stitch guide 58. The journal 57 is further grasped by an oscillating crank 59, the other end of which is hinged to the journal 26 of the needle bar carrier 21.

Figure 7:
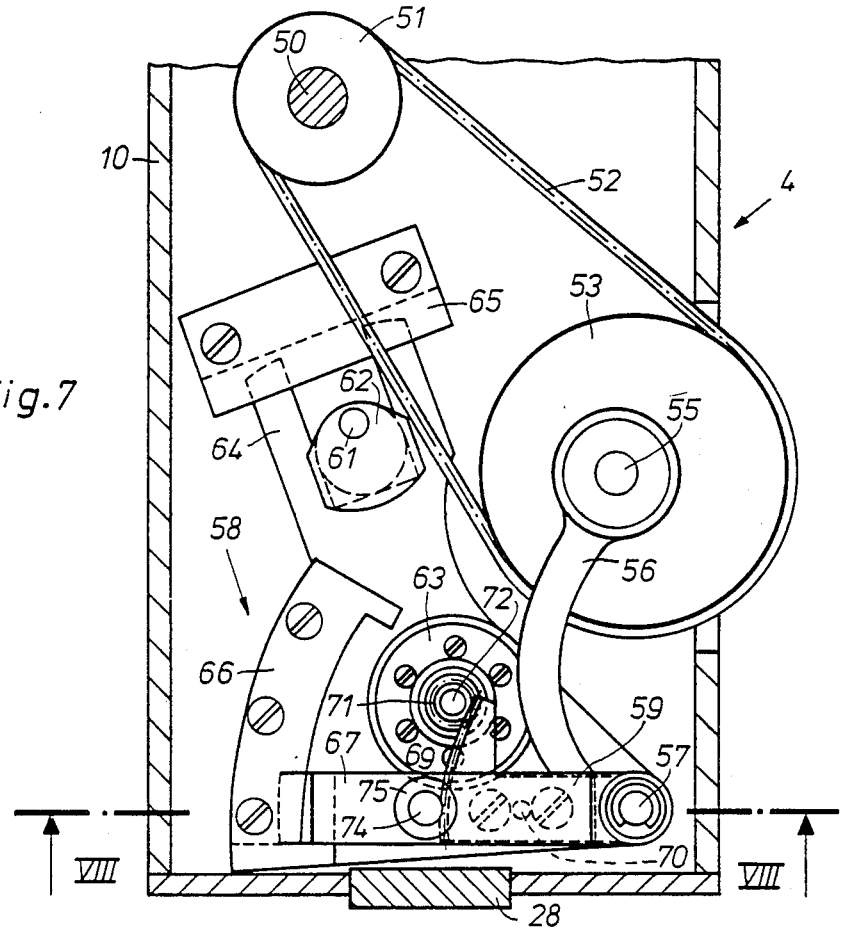
FIG. 7 is a stitch guide mounted in the head, sectioned along line VIIa-VIIa of FIG. 2 and line VIIb—VIIb of FIG. 8.
Figure 8:
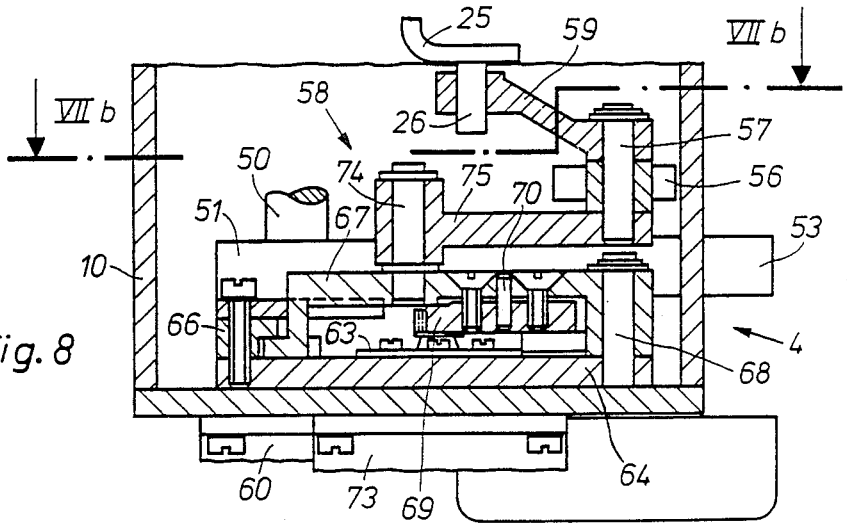
FIG. 8 is a top view of the stitch guide, sectioned along line VIII—VIII of FIG. 7.

The stitch guide 58 shown in FIG. 7 and 8 is constructed as follows: a step motor 60 secured to the outside of the housing 10 is provided with a motor shaft 61, guided into the housing 10. An eccentric 62 is secured to the shaft and actuates a fork 64, seated in a bearing 63, the fork-shaped end protruding into a guide 65 that is firmly joined to the housing. A positioning element 67, which can swivel about a fixed journal 68 of the fork 64, is moved in a guide 66, secured to the fork 64. A gear segment 69 is fastened to the positioning element 67 and centered by a fixing pin 70. The gear segment 69 engages with a pinion 71, which is firmly connected to the shaft 72 of a stepmotor 73, again secured to the outside of the housing 10 and admitted into it.

The positioning element 67 carries a journal 74, on which is pivoted an oscillating crank 75. At the other end of the oscillating crank 75 is secured the already mentioned journal 57, with which the oscillating cranks 56 and 59 engage in the familiar manner.

On the shaft 50 (FIGS. 2 and 3) is secured an eccentric 76, which is grasped by an eccentric rod 77. Through an opening 78 in the housing, the eccentric rod 77 protrudes out of the housing 10 and actuates an oscillating lever 79 (FIG. 3), which is fastened to the swiveling journal 80 of a plate 81, firmly joined in the housing 10. The oscillating lever 79 is provided with a lengthwise hole 82, in which the point of articulation of the eccentric rod 77 can be adjusted by a screw 83. Fastened to the journal 80 is another oscillating lever 84, the free end of which is pivoted on a connecting rod 85. The connecting rod 85 is hinged to an oscillating lever 86, which is firmly engaged by a journal 87, hinged in the plate 81. Also secured to the journal 87 is an oscillating lever 88, which is linked to an angle lever 90 across a connecting rod 89. The angle lever 90 is mounted on a lug 91 of the press bar 38 and is provided with a free arm 92 in the shape of a ball, which reaches under and supports a stopping face 93 of the press bar 38. A lever mechanism 94 is formed from the individual parts 77 and 78 through 91.

The arrangement operates as follows:

The turning motion of the motor shaft 12 of motor 11 drives the crank 13 and, by the latter across the journal 15, the toothed belt gear 14. The rotational motion of the toothed belt gear 14 is transmitted across the toothed belt 48 and the toothed belt gear 49 to the shaft 50 and, thereby, to the toothed belt gear 51 and the eccentric 76.

The rotational motion of the toothed belt gear 51 is conveyed further across the toothed belt 52 to the toothed belt gear 53 and, thus, to the driven shaft 54. The eccentrically arranged journal 55 engenders oscillating motions in the eccentric rod 56. These oscillating motions are conveyed to the journal 57, which is a part of the stitch guide 58, the mode of operation of which is to be described below.

To produce straight stitches, the stitch guide 58 should be adjusted such that the oscillating motions transmitted by the eccentric rod 56 are not conveyed to the needle bar carrier 21. Accordingly, the oscillating motions only reach the needle bar 5, being transmitted by the crank 13 across the journal 15 and the eccentric rod 16 to the clamp 19, so that the needle bar 5 is only driven up and down.

With each rotation of the shaft 50 and, consequently, of the eccentric 76, the arm 92 of the angle lever 90 is deflected by the lever mechanism 94, moving downward from its upper position. Immediately prior to the entry of the needle 6 in the sewing hole 9, the arm 92 is lifted off from the stopping face 93 and under the action of the pressing spring 45 the needle 6 is forced onto the sewing material. As soon as the formation of the stitch is completed and the needle 6 has again left the sewing hole 9, the arm 92 is again moved upward by the described lever mechanism 94 against the stopping face 93, thereby lifting the press foot 39 away from the sewing material.

During this relative motion of needle bar 5 and press foot 38, the free end 42 of the peg 41 is displaced exclusively in the vertical direction in the slot 30 of the plate 29.

To execute zig zag stitches, the requisite cross stitch width should be adjusted at the stitch guide 58. The oscillating motions transmitted by the eccentric rod 56 are now conveyed from the journal 57 across the oscillating crank 59 and the journal 26 for the shackle 25 of the needle bar carrier 21. In this way, the needle bar carrier 21 executes transverse movements about the bearing journal 23, while the needle bar 5 is driven up and down in the customary manner.

The transverse motions of the needle bar carrier 21 drive the end 42 of the peg 41, accommodated in the slot 30. The opposite end of the peg 41 occasions a swiveling motion of the press bar 38 about its lengthwise axis, so that this follows the needle bar carrier 21 in its transverse motions in synchronization and the needle 6 is constantly inserted into the sewing hole 40 of the press foot 39.

In order to reduce the mass of the press bar 38, the latter is configured relatively short and provided with a bore 44. To reduce the frictional resistance occasioned by the swiveling motion, the balls 46 and 47 are provided between the pressing spring 45 and the press bar 38, so that the balls 46, 47 roll against each other during vertical and horizontal movements of the press bar 38.

When the seam is finished, the cylinder 35 is activated in such manner (not shown) that the piston rod 36 is extended and, via the clamp 34, raises the carrier 31 and, consequently, also the sleeve 33, along with the bushing 37, the press bar 38 and the press foot 39. The sewn material can now be removed effortlessly and a new piece of material inserted, if the needle bar 5 under the action of a positioning drive (not shown) has been moved previously to a position beyond the sewing material.

The stitch guide 58 of the sewing machines operates as follows. In the position of the fork 64 shown in FIG. 7, the position of the stitch is adjusted in such manner that the needle bar carrier 21 assumes its middle position. To change the position of the stitch, the step motor 60 is energized in a manner not shown, so that the motor shaft 61 is driven right or left through a certain angle of rotation. In this way, the eccentric 62 is deflected from its middle position and exerts a force on the end of the fork 64 which embraces it. For example, a right hand turning of the eccentric 62 produces a swiveling motion of the fork 64 to the left about the bearing 63. The new position of the fork 64 is transmitted via the oscillating crank 75 to the journal 57, whose particular position is determined by the position of the oscillating crank 75 and the eccentric rod 56. The journal 57, accordingly, by means of the described adjustment process is shifted to the right side in FIG. 8, likewise deflecting the needle bar carrier 21 to the right via the oscillating crank 59. A turning of the eccentric 62 in the opposite direction, contrariwise, produces a deflection of the needle bar carrier 21 to the left.

The cross stitch width can be adjusted by the positioning element 67. In FIG. 2, the stitch guide 58 is shown at the maximum cross stitch width, in FIG. 7 and 8 it is at null width.

In the position of the positioning element 67 shown in FIG. 7, this element as well as the oscillating crank 75 stands perpendicular to the eccentric rod 56. Oscillating motions of the eccentric rod 56 with a stroke corresponding to twice the eccentricity of the journal 55 relative to the driven shaft 54 cause the journal 57 to be moved along a segment of a circular arc about the journal 74 with a radius corresponding to the length of the oscillating crank 75. Since the length of the oscillating crank 75 is a multiple larger than the stroke of the eccentric rod 56, the oscillating crank 75 executes only minimal pendulum motions, the horizontal component of which motions is negligibly small, due to the perpendicular arrangement of oscillating crank 59, which joins the journal 57 to the needle bar carrier 21 and extends parallel to the oscillating crank 75 in this position, accordingly executes essentially pendulum motions about the journal 26 of the needle bar carrier 21, without appreciably deflecting the latter in the horizontal direction.

To change the cross stitch width, the step motor 73 is activated in a manner not shown. The turning of the motor shaft 72 is transmitted by the pinion 71 to the gear segment 69 and thereby to the positioning element 67. The positioning element 67 is hereby swiveled about the journal 68, so that an angle deviating from the vertical is formed between the positioning element 67 or the oscillating crank 75 and the eccentric rod 56. The journal 57 as a result of the oscillating motions conveyed by the eccentric rod 56 is again moved by the oscillating crank 75 through a segment of a circular arc about the journal 74. Because of the new position of this movement path, however, the component of the motion of the journal 57 in the horizontal direction is sufficiently large, so that in addition to the pendulum motions of the oscillating crank 59 about the journal 26 there is transmitted a force acting perpendicular to the former and deflecting the needle bar carrier 21 in the horizontal direction.

Figure 10:
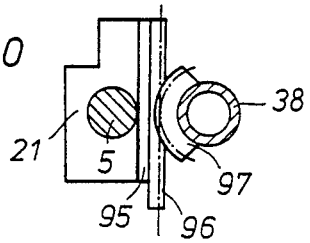
FIG. 10 is a top view partly in section of the arrangement of FIG. 9

In FIGS. 9 and 10, an additional design configuration for activation of the press bar 38 by the needle bar carrier 21 is shown. A plate 95, carrying a toothed rack 96, is fastened on the side of the needle bar carrier 21 which faces the press bar 38. The rack 96 engages with a gear segment 97, which is firmly joined to the press bar 38.

When the needle bar carrier 21 is deflected to execute zig zag seams, this motion is transmitted by the rack 96 across the gear segment 97 to the press bar 38. Hence, the press bar 38 executes oscillating motions about its lengthwise axis. The width of the tooth face of the rack 96 is a multiple larger than that of the gear segment 97, so that the teeth of the rack 96 and gear segment 97 are still engaged, even when the needle bar 5 and press bar 38 are moving up and down relative to each other.

While specific embodiments of the invention have been shown and described in detail to illustrate the application of the principals of the invention, it will be understood that the invention may be embodied otherwise without departing from such principals.

What is claimed is:

1. A press mechanism for a zig zag sewing machine comprising a hollow sleeve, a press foot having a shank portion engageable in said sleeve and being rotatable therein, said press foot having a lower end with an opening therethrough for a needle to pass through, a radially extending peg member connected to said shank portion of said press foot and said sleeve having a slot through which said peg member extends, said peg member comprising a drivable element for rotating the shank portion of said press foot in said sleeve.

2. A sewing machine according to claim 1, including a pressing spring carried by said sleeve and biasing said press bar in a longitudinal axial direction in said sleeve.

3. A sewing machine according to claim 2, including at least one ball between said spring and said press bar.

4. A press mechanism according to claim 1, wherein said shank portion includes an upper part in said sleeve which is hollow, at least one ball engaged in the hollow end of said upper portion of said shank portion in said sleeve being of a size to rest therein without passing therethrough, a biasing spring in said sleeve acting on said ball to urge said press foot in a downward direction.

5. A press mechanism according to claim 1, including a drive member carried by said press mechanism which is engageable by another member to drive said press mechanism in a timed relationship to a swinging sewing needle.

6. A press mechanism according to claim 1, wherein the shank portion of said press foot includes a stop, a lifting member pivotally mounted at the exterior of said sleeve adjacent said stop, lifting means for driving said lifting member to engage said stop, lifting said shank portion upwardly raising said press foot.

7. A sewing machine comprising:

hollow needle bar carrier, means supporting said needle bar carrier for pivotal movement about a substantially horizontal axis intermediate the height of said needle bar carrier in order to permit swinging movement of said needle bar carrier, a needle bar adapted to carry a sewing needle and being reciprocatable in said needle bar carrier;

a press foot assembly with a sewing needle pass-through opening and being adapted to overlie the material to be sewn in alignment with the needle carried by said needle bar;

means mounting said press foot assembly for swinging movement adjacent said needle bar carrier, and drive means connected to said press foot assembly and said needle bar carrier for swinging said needle bar carrier and said press foot in timed relationship to each other so as to time the swinging movement of said needle bar carrier to the swinging movement of said press foot assembly;

said drive means includes a peg carried by said press foot assembly and connected to said press foot and engaged with said needle bar carrier and being swingable on a swinging movement of said needle bar carrier to shift said press foot.

8. A sewing machine comprising:

hollow needle bar carrier, means supporting said needle bar carrier for pivotal movement about a substantially horizontal axis intermediate the height of said needle bar carrier in order to permit swinging movement of said needle bar carrier, a needle bar adapted to carry a sewing needle and being reciprocatable in said needle bar carrier;

a press foot assembly with a sewing needle pass-through opening and being adapted to overlie the material to be sewn in alignment with the needle carried by said needle bar;

means mounting said press foot assembly for swinging movement adjacent said needle bar carrier, and drive means connected to said press foot assembly and said needle bar carrier for swinging said needle bar carrier and said press foot in timed relationship to each other so as to time the swinging movement of said needle bar carrier to the swinging movement of said press foot assembly;

wherein said drive means includes a rack and pinion interconnection between said press foot assembly and said needle bar carrier

9. A sewing machine comprising:

a sewing machine housing;

a needle bar carrier mounted in said housing for pivotal movement about a substantially horizontal axis, a needle bar reciprocatable in said needle bar carrier and having a needle at its lower end;

a press mechanism alongside said needle bar carrier including a press foot at its lower end with an opening through which the needle is movable;

a drive linkage connected between said needle bar carrier and said press foot for driving said press foot through a transfer swinging movement in timed relationship to a swinging movement of said needle bar and said needle bar carrier;

said press mechanism includes a sleeve, and a press bar reciprocatable and pivotal in said sleeve about a longitudinal axis.

10. A sewing machine comprising:

a sewing machine housing;

a needle bar carrier mounted in said housing for pivotal movement about a substantially horizontal axis, a needle bar reciprocatable in said needle bar carrier and having a needle at its lower end;

a press mechanism alongside said needle bar carrier including a press foot at its lower end with an opening through which the needle is movable;

a drive linkage connected between said needle bar carrier and said press foot for driving said press foot through a transfer swinging movement in timed relationship to a swinging movement of said needle bar and said needle bar carrier;

a pressing spring carried by said sleeve and biasing said press bar in a longitudinal axial direction in said sleeve;

a ball between said spring and said press bar.

11. A sewing machine comprising:

a sewing machine housing;

a needle bar carrier mounted in said housing for pivotal movement about a substantially horizontal axis, a needle bar reciprocatable in said needle bar carrier and having a needle at its lower end;

a press mechanism alongside said needle bar carrier including a press foot at its lower end with an opening through which the needle is movable;

a drive linkage connected between said needle bar carrier and said press foot for driving said press foot through a transfer swinging movement in timed relationship to a swinging movement of said needle bar and said needle bar carrier;

said press mechanism includes a peg projecting radially outwardly therefrom, said needle bar carrier having a slot into which said peg extends.

12. A sewing machine comprising:

a sewing machine housing;

a needle bar carrier mounted in said housing for pivotal movement about a substantially horizontal axis, a needle bar reciprocatable in said needle bar carrier and having a needle at its lower end;

a press mechanism alongside said needle bar carrier including a press foot at its lower end with an opening through which the needle is movable;

a drive linkage connected between said needle bar carrier and said press foot for driving said press foot through a transfer swinging movement in timed relationship to a swinging movement of said needle bar and said needle bar carrier;

said driving means comprises a rack and a pinion engaged by said rack connected to said needle bar carrier and said press mechanism.

13. A sewing machine comprising:

a sewing machine housing;

a needle bar carrier mounted in said housing for pivotal movement about a substantially horizontal axis, a needle bar reciprocatable in said needle bar carrier and having a needle at its lower end;

a press mechanism alongside said needle bar carrier including a press foot at its lower end with an opening through which the needle is movable;

a drive linkage connected between said needle bar carrier and said press foot for driving said press foot through a transfer swinging movement in timed relationship to a swinging movement of said needle bar and said needle bar carrier;

said driving means comprises a gear carried by said press mechanism, said needle bar carrier having an exterior surface with a rack thereon engaged with said pinion.

14. A sewing machine comprising:

a liftable and lowerable needle bar, said needle bar executing transverse motions;

a presser foot being liftable and lowerable in timed relationship with said needle bar and said press foot being lowerable onto a workpiece laterally with regard to a central position when said needle bar executes transverse motion;

said presser foot being mounted on a pressing arrangement;

said presser foot being movable in the direction of its lifting movement as well as in the transverse direction;

a guiding means for guiding said presser foot parallel to the workpiece surface;

the lifting movement of said presser foot being executed relative to the needle bar movement;

the transverse movement of said presser foot being in synchronization with the transverse movement of said needle bar, the transverse movement of said needle bar being executed by a driving means;

said presser foot being connected to said driving means of said needle bar by a driving connection, said driving connection being a peg mounted on said pressing arrangement, said peg extending away from said pressing arrangement and having an opposite end engageable with said needle bar.

* * * * *